US005929025A

United States Patent [19]

De Block et al.

[11] Patent Number: 5,929,025

[45] Date of Patent: Jul. 27, 1999

[54] STABILIZED FABRIC SOFTENING COMPOSITIONS COMPRISING A FABRIC SOFTENING COMPOUND, FATTY ACID, AND PERFUME

[75] Inventors: Franciscus Joseph Madeleine De Block, Merchtem; Bruno Albert Jean Hubesch, Tervuren; Raphael Angeline Alfons Ceulemans, Lubbeek (Linden), all of Belgium

[73] Assignee: The Procter & Gamble Company, Cincinnati, Ohio

[21] Appl. No.: 09/029,780

[22] PCT Filed: Sep. 13, 1996

[86] PCT No.: PCT/US96/14865

§ 371 Date: Jul. 29, 1998

§ 102(e) Date: Jul. 29, 1998

[87] PCT Pub. No.: WO97/11142

PCT Pub. Date: Mar. 27, 1997

[30] Foreign Application Priority Data

Sep. 18, 1995 [EP] European Pat. Off. ..... 95870104

[51] Int. Cl.[6] ..... C11D 1/62; C11D 9/00; C11D 3/50

[52] U.S. Cl. ..... 510/515; 510/101; 510/287; 510/353; 510/389; 510/394; 510/399; 510/481; 510/488; 510/504; 510/521; 510/522; 510/526

[58] Field of Search ..... 510/101, 287, 510/353, 389, 394, 399, 481, 488, 504, 515, 521, 522, 526

[56] References Cited

U.S. PATENT DOCUMENTS

| | | | |
|---|---|---|---|
| 4,308,024 | 12/1981 | Wells | 8/137 |
| 4,426,299 | 1/1984 | Verbruggen | 252/8.8 |
| 5,403,500 | 4/1995 | Turner | 252/8.8 |
| 5,409,621 | 4/1995 | Ellis et al. | 252/8.8 |
| 5,474,690 | 12/1995 | Wahl et al. | 252/8.8 |
| 5,545,340 | 8/1996 | Wahl et al. | 510/517 |
| 5,562,849 | 10/1996 | Wahl et al. | 510/521 |
| 5,574,179 | 11/1996 | Wahl et al. | 554/110 |
| 5,652,205 | 7/1997 | Hartman et al. | 510/101 |
| 5,700,387 | 12/1997 | Haq et al. | 252/8.63 |
| 5,721,205 | 2/1998 | Barnabas et al. | 510/522 |
| 5,767,062 | 6/1998 | Trinh et al. | 510/516 |
| 5,773,409 | 6/1998 | Haq et al. | 510/521 |

*Primary Examiner*—Yogendra Gupta
*Assistant Examiner*—Charles Boyer
*Attorney, Agent, or Firm*—Robert B. Aylor

[57] ABSTRACT

The present invention relates to stabilized liquid fabric softening composition comprising a) one or more biodegradable fabric softening compounds, b) one or more fatty acid compounds, wherein the ratio of said fabric softening agents to said fatty acid compounds is from 25:1 to 6.5:1.

12 Claims, No Drawings

STABILIZED FABRIC SOFTENING COMPOSITIONS COMPRISING A FABRIC SOFTENING COMPOUND, FATTY ACID, AND PERFUME

FIELD OF THE INVENTION

The present invention relates to fabric softening compositions showing excellent stability upon storage. More particularly, it relates to liquid fabric softening compositions.

BACKGROUND OF THE INVENTION

Liquid fabric compositions are well known to the consumer and may be divided in two types: concentrated compositions with 5% to 80% of fabric softening agents and diluted compositions with 1% to 5% of fabric softening agents. Concentrated fabric softening compositions are well appreciated by consumer. However, concentrated compositions may be expensive. This may be due to processing cost and/or material cost of the formulation. Diluted fabric softening compositions, are also known by consumer for providing a cheaper alternative to concentrated compositions without reducing the softness performance.

Consumer acceptance of such compositions is determined not only by the performance achieved with these products but the aesthetics associated therewith. Viscosity of the product is therefore an important aspect of the successful formulation of such commercial products: stable medium to medium-high viscosities being highly preferred by consumer. By medium-high viscosities is meant viscosities of 50 cps to 150 cps when the fabric softening composition is in a diluted form and viscosities of 30 cps to 90 cps when the fabric softening composition is in a concentrated form. To this end, thickeners such as compounds of the polyacrylamide, polysacharide or polyurethanes type have been widely used in such compositions. Although, these compounds are effective in providing the thickening effect, they increase the cost of the formulation without adding any other benefit to the product.

Another aesthetic point which may be of concern to the consumer is that of resulting odour of the product. To this end, products which contain a high level of perfume relative to the total amount of biodegradable fabric softening components and fatty acid components present within the composition are most preferred. However, a problem encountered with such high ratios is that of stability of the perfume, especially where the fabric softening composition contains a low amount of such actives (i.e sum of biodegradable fabric softening components and fatty acid components), especially less than 10% by weight of the composition.

Still another important aspect of successful formulation of such commercial product is that of the resulting storage stability after exposure to high temperatures.

The Applicant has now found that the use of high levels of fatty acids relative to the level of biodegradable fabric softening agents in a liquid fabric softening composition overcomes the problems.

It is therefore an object of the invention to provide a liquid fabric softening composition which has a suitable viscosity, provide excellent softening benefit and is inexpensive.

It is another object of the invention to provide at liquid fabric softening composition with effective storage stability.

It is another object of the invention to provide a liquid fabric softening composition which also contain high level of perfumes relative to the total amount of biodegradable fabric softening components and fatty acid components.

SUMMARY OF THE INVENTION

The present invention relates to a liquid fabric softening composition comprising a) one or more biodegradable fabric softening compounds, b) one or more fatty acid compounds, wherein the ratio of said fabric softening agents to said fatty acid compounds is from 25:1 to 6.5:1.

In a preferred embodiment of the invention, the liquid fabric softening composition further comprises a perfume composition in a ratio of said perfume to said total amount of biodegradable fabric softening components and fatty acid components of 1:40 to 1:2.

In another preferred embodiment of the invention, the liquid fabric softening composition is used in the rinse cycle of a laundry washing process.

DETAILED DESCRIPTION OF THE INVENTION

Biodegradable Fabric Softening Compound

An essential component of the invention is a biodegradable fabric softening compound.

Fabric softening compositions, in particular fabric softening compositions to be used in the rinse cycle of laundry washing processes, are well known.

Biodegradable quaternary ammonium compounds contain long chain alk(en)yl groups interrupted by functional groups such as carboxy groups.

Said materials and fabric softening compositions containing them are disclosed in numerous publications such as EPA 040 562, and EPA 239 910.

In EPA 239 910 is disclosed that a pH range of from 2.5 to 4.2 provides optimum storage stability to said rapidly biodegradable ammonium compounds.

The quaternary ammonium compounds and amine precursors herein have the formula (I) or (II), below:

(I)

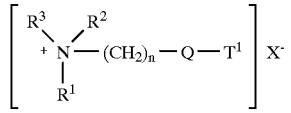

or (II)

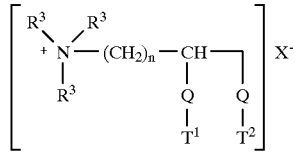

Q is selected from —O—C(O)—, —C(O)—O—, —O—C(O)—O—, —$NR^4$—C(O)—, —C(O)—$NR^4$—; $R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from 1 to 4; and $X^-$ is a softener-compatible anion.

Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched.

Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowoyl-oxy-ethyl)-N,N-dimethyl ammonium chloride;
2) N,N-di(tallowyl-oxy-ethyl)-N-methyl, N-(2-hydroxyethyl);
3) N,N-di(2-tallowyl-oxy-2-oxo-ethyl)-N,N-dimethyl ammonium chloride;
4) N,N-di(2-tallowyl-oxyethylcarbonyloxyethyl)-N,N-dimethyl ammonium chloride;
5) N-(2-tallowyl-oxy-2-ethyl)-N-(2-tallowyloxy-2-oxo-ethyl)-N,N-dimethyl ammonium chloride;
6) N,N,N-tri(tallowyl-oxy-ethyl)-N-methyl ammonium chloride;
7) N-(2-tallowyl-oxy-2-oxoethyl)-N-(tallowyl-N,N-dimethyl-ammonium chloride; and
8) 1,2-ditallowyl-oxy-3-trimethylammoniopropane chloride; and mixtures of any of the above materials.

Of these, compounds 1–7 are examples of compounds of Formula (I); compound 8 is a compound of Formula (II).

Particularly preferred is N,N-di(tallowoyl-oxy-ethyl)-N,N-dimethyl ammonium chloride, where the tallow chains are at least partially unsaturated.

The level of unsaturation of the tallow chain can be measured by the Iodine Value (IV) of the corresponding fatty acid, which in the present case should preferably be in the range of from 5 to 100 with two categories of compounds being distinguished, having a IV below or above 25.

Indeed, for compounds of Formula (I) made from tallow fatty acids having a IV of from 5 to 25, preferably 15 to 20, it has been found that a cis/trans isomer weight ratio greater than 30/70, preferably greater than 50/50 and more preferably greater than 70/30 provides optimal concentrability.

For compounds of Formula (I) made from tallow fatty acids having a IV of above 25, the ratio of cis to trans isomers has been found to be less critical unless very high concentrations are needed.

Other examples of suitable quaternary ammoniums of Formula (I) and (II) are obtained by, e.g.:

replacing "tallow" in the above compounds with, for example, coco, palm, lauryl, oleyl, ricinoleyl, stearyl, palmityl, or the like, said fatty acyl chains being either fully saturated, or preferably at least partly unsaturated;

replacing "methyl" in the above compounds with ethyl, ethoxy, propyl, propoxy, isopropyl, butyl, isobutyl or t-butyl;

replacing "chloride" in the above compounds with bromide, methylsulfate, formate, sulfate, nitrate, and the like.

In fact, the anion is merely present as a counterion of the positively charged quaternary ammonium compounds. The nature of the counterion is not critical at all to the practice of the present invention. The scope of this invention is not considered limited to any particular anion.

By "amine precursors thereof" is meant the secondary or tertiary amines corresponding to the above quaternary ammonium compounds, said amines being substantially protonated in the present compositions due to the claimed pH values.

For the preceding biodegradable fabric softening agents, the pH of the compositions herein is an essential parameter of the present invention. Indeed, it influences the stability of the quaternary ammonium or amine precursors compounds, especially in prolonged storage conditions.

The pH, as defined in the present context, is measured in the neat compositions at 20° C. For optimum hydrolytic stability of these compositions, the neat pH, measured in the above-mentioned conditions, must be in the range of from 2.0 to 4.5. Preferably, where the liquid fabric softening compositions of the invention are in a concentrated form, the pH of the neat composition is in the range of 2.0 to 3.5, while if it is in a diluted form, the pH of the neat composition is in the range of 2.0 to 3.0. The pH of these compositions herein can be regulated by the addition of a Bronsted acid.

Examples of suitable acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids.

The quaternary ammonium or amine precursors compounds herein are present at levels of from 1% to 80% of compositions herein, depending on the composition execution which can be dilute with a preferred level of active biodegradable fabric softening components from 1% to 5%, or concentrated, with a preferred level of active biodegradable fabric softening components from 5% to 80%, more preferably 10% to 50%, most preferably 15% to 35% by weight.

Additional fabric softening materials may be used in addition to the biodegradable fabric softener. Theses may be selected from additional cationic fabric softening material such as di-long alkyl chain ammonium chloride, nonionic, amphoteric or anionic fabric softening material excluding fatty acids as defined herein after. Disclosure of such materials may be found in U.S. Pat. Nos. 4,327,133; 4,421,792; 4,426,299; 4,460,485; 3,644,203 and 4,661,269.

Fatty Acid

Another essential component of the invention is a fatty acid compound.

Suitable fatty acids include those containing from 10 to 25, preferably from 12 to 25 total carbon atoms, with the fatty moiety containing from 10 to 22, preferably from 16 to 22, carbon atoms. The shorter moiety contains from 1 to 4, preferably from 1 to 2 carbon atoms.

The level of unsaturation of the tallow chain can be measured by the Iodine Value (IV) of the corresponding fatty acid, which in the present case should preferably be in the range of from 5 to 100, more preferably in the range of from 0 to 25.

Specific examples of fatty acid compounds suitable for use in the aqueous fabric softening compositions herein include compounds selected from lauric acid, myristic acid, palmitic acid, stearic acid, arachidic acid, behenic acid, oleic acid, coconut fatty acid, tallow fatty acid, partially hydrogenated tallow fatty acid and mixtures thereof.

A most preferred fatty acid compound is tallow fatty acid with an Iodine Value (IV) of 18.

Another essential element of the invention is the ratio of said biodegradable fabric softening agents to said fatty acid compounds. Preferred ratios of said biodegradable fabric softening agents to said fatty acid compounds are from 25:1 to 6.5:1, more preferably from 20:1 to 10:1 and most preferably from 20:1 to 15:1.

Ratios below 6.5:1 would tend to provide fabric softening compositions with a poor storage stability due to a phase instability, while ratios above 25:1 would not produce sufficient built-on viscosity of the fabric softening compositions to be noticeable.

Compositions according to the present invention have further been found to be beneficial to high ratios of perfumes relative to the total amount of biodegradable fabric softening components and fatty acid components which allows the use of highly scented product favoured by some consumer. By high ratios is meant ratios of perfume to said total amount of biodegradable fabric softener components and fatty acid components components of 1:40 to 1:2, preferably 1:20 to 1:2 and more preferably 1:10 to 1:3.

Optional Ingredients

Fully formulated fabric softening compositions can contain polymers having a partial or net cationic charge.

Such polymers can be used at levels of from 0.001% to 10%, preferably 0.01% to 2% by weight of the compositions.

Such polymers having a partial cationic charge can be polyamine N-oxide containing polymers which contain units having the following structure formula (A):

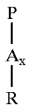

(A)

wherein P is a polymerisable unit, whereto the R—N→O group can be attached to or wherein the R—N→O group forms part of the polymerisable unit or a combination of both.

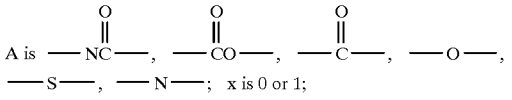

A is —NC(=O)—, —CO(=O)—, —C(=O)—, —O—, —S—, —N—; x is 0 or 1;

R are aliphatic, ethoxylated aliphatics, aromatic, heterocyclic or alicyclic groups or any combination thereof whereto the nitrogen of the N→O group can be attached or wherein the nitrogen of the N→O group is part of these groups.

The N→O group can be represented by the following general structures:

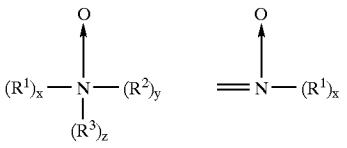

wherein $R^1$, $R^2$, and $R^3$ are aliphatic groups, aromatic, heterocyclic or alicyclic groups or combinations thereof, x or/and y or/and z is 0 or 1 and wherein the nitrogen of the N→O group can be attached or wherein the nitrogen of the N→O group forms part of these groups.

The N→O group can be part of the polymerisable unit (P) or can be attached to the polymeric backbone or a combination of both.

Suitable polyamine N-oxides wherein the N→O group forms part of the polymerisable unit comprise polyamine N-oxides wherein R is selected from aliphatic, aromatic, alicyclic or heterocyclic groups.

One class of said polyamine N-oxides comprises the group of polyamine N-oxides wherein the nitrogen of the N→O group forms part of the R-group. Preferred polyamine N-oxides are those wherein R is a heterocyclic group such as pyridine, pyrrole, imidazole, pyrrolidine, piperidine, quinoline, acridine and derivatives thereof.

Another class of said polyamine N-oxides comprises the group of polyamine N-oxides wherein the nitrogen of the N→O group is attached to the R-group.

Other suitable polyamine N-oxides are the polyamine oxides whereto the N→O group is attached to the polymerisable unit.

Preferred class of these polyamine N-oxides are the polyamine N-oxides having the general formula (A) wherein R is an aromatic, heterocyclic or alicyclic groups wherein the nitrogen of the N→O functional group is part of said R group.

Examples of these classes are polyamine oxides wherein R is a heterocyclic compound such as pyridine, pyrrole, imidazole and derivatives thereof.

Another preferred class of polyamine N-oxides are the polyamine oxides having the general formula (A) wherein R are aromatic, heterocyclic or alicyclic groups wherein the nitrogen of the N→O functional group is attached to said R groups.

Examples of these classes are polyamine oxides wherein R groups can be aromatic such as phenyl.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof.

The amine N-oxide polymers useful herein typically have a ratio of amine to the amine N-oxide of 10:1 to 1:1000000. However the amount of amine oxide groups present in the polyamine N-oxide containing polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6.

The polyamine N-oxide containing polymer can be obtained in almost any degree of polymerisation. The degree of polymerisation is not critical provided the material has the desired water-solubility and dye-suspending power.

Typically, the average molecular weight of the polyamine N-oxide containing polymer is within the range of 500 to 1000,000; preferably from 1,000 to 50,000, more preferably from 2,000 to 30,000, most preferably from 3,000 to 20,000.

Such polymers having a net cationic charge include polyvinylpyrrolidone (PVP) as well as copolymers of N-vinylimidazole N-vinyl pyrrolidone, having an average molecular weight range in the range 5,000 to 100,000, preferably 5,000 to 50,000; said copolymers having a molar ratio of N-vinylimidazole to N-vinylpyrrolidone from 1 to 0.2, preferably from 0.8 to 0.3.

Other Optional Ingredients Include

Additional softening agents: which are nonionic fabric softener materials. Typically, such nonionic fabric softener materials have a HLB of from 2 to 9, more typically from 3 to 7. Such nonionic fabric softener materials tend to be readily dispersed either by themselves, or when combined with other materials such as single-long-chain alkyl cationic surfactant described in detail hereinafter. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g. >40° C.) and relatively water-insoluble.

The level of optional nonionic softener in the compositions herein is typically from 0.1% to 10%, preferably from 1% to 5%.

Preferred nonionic softeners are fatty acid partial esters of polyhydric alcohols, or anhydrides thereof, wherein the alcohol, or anhydride, contains from 2 to 18, preferably from 2 to 8, carbon atoms, and each fatty acid moiety contains from 12 to 30, preferably from 16 to 20, carbon atoms. Typically, such softeners contain from one to 3, preferably 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from 12 to 30, preferably from 16 to 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Commercial sorbitan monostearate is a suitable material. Mixtures of sorbitan stearate and sorbitan palmitate having stearate/palmitate weight ratios varying between 10:1 and 1:10, and 1,5-sorbitan esters are also useful.

Glycerol and polyglycerol esters, especially glycerol, diglycerol, triglycerol, and polyglycerol mono- and/or di-esters, preferably mono-, are preferred herein (e.g. polyglycerol monostearate with a trade name of Radiasurf 7248).

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

Surfactant/Concentration Aids

Although as stated before, relatively concentrated compositions of the unsaturated material of Formula (I) and (II) above can be prepared that are stable without the addition of concentration aids, the concentrated compositions of the present invention may require organic and/or inorganic concentration aids to go to even higher concentrations and/or to meet higher stability standards depending on the other ingredients.

Surfactant concentration aids are typically selected from the group consisting of single long chain alkyl cationic surfactants; nonionic surfactants; amine oxides; fatty acids; or mixtures thereof, typically used at a level of from 0 to 15% of the composition.

Such mono-long-chain-alkyl cationic surfactants useful in the present invention are, preferably, quaternary ammonium salts of the general formula:

$$[R^2N^+R^3]X^-$$

wherein the $R^2$ group is $C_{10}$–$C_{22}$ hydrocarbon group, preferably $C_{12}$–$C_{18}$ alkyl group of the corresponding ester linkage interrupted group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester at from 0.1% to 20% by weight of the softener active. Each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts and their imidazoline precursors useful in the present invention have the general formula:

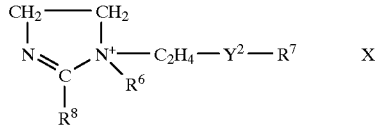

wherein $Y^2$ is —C(O)—O—, —O—(O)C—, —C(O)—N($R^5$)—, or —N($R^5$)—C(O)— in which $R^5$ is hydrogen or a $C_1$–$C_4$ alkyl radical; $R^6$ is a $C_1$–$C_4$ alkyl radical or H (for imidazoline precursors); $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

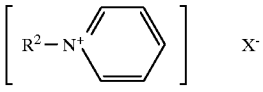

wherein $R^2$ and X- are as defined above. A typical material of this type is cetyl pyridinium chloride.

Nonionic Surfactant (Alkoxylated Materials)

Suitable nonionic surfactants for use herein include addition products of ethylene oxide and, optionally, propylene oxide, with fatty alcohols, fatty acids, fatty amines, etc.

Suitable compounds are substantially water-soluble surfactants of the general formula:

$$R^2—Y—(C_2H_4O)_z—C_2H_4OH$$

wherein $R^2$ is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from 8 to 20, preferably from 10 to 18 carbon atoms.

Y is typically —O—, —C(O)O—, —C(O)N(R)—, or —C(O)N(R)R—, in which $R^2$ and R, when present, have the meanings given hereinbefore, and/or R can be hydrogen, and z is at least 8, preferably at least 10–11.

The nonionic surfactants herein are characterized by an HLB (hydrophilic-lipophilic balance) of from 7 to 20, preferably from 8 to 15.

Examples of particularly suitable nonionic surfactants include

Straight-Chain, Primary Alcohol Alkoxylates such as tallow alcohol-EO(11), tallow alcohol-EO(18), and tallow alcohol-EO(25);

Straight-Chain, Secondary Alcohol Alkoxylates such as 2-$C_{16}$EO(11); 2-$C_{20}$EO(11); and 2-$C_{16}$EO(14);

Alkyl Phenol Alkoxylates, such as p-tridecylphenol EO(11) and p-pentadecylphenol EO(18), as well as Olefinic Alkoxylates, and Branched Chain Alkoxylates such as branched chain primary and secondary alcohols which are available from the well-known "OXO" process.

Amine Oxides

Suitable amine oxides include those with one alkyl or hydroxyalkyl moiety of 8 to 28 carbon atoms, preferably from 8 to 16 carbon atoms, and two alkyl moieties selected from the group consisting of alkyl groups and hydroxyalkyl groups with 1 to 3 carbon atoms.

Examples include dimethyloctylamine oxide, diethyldecylamine oxide, bis-(2-hydroxyethyl)dodecylamine oxide, dimethyldodecyl-amine oxide, dipropyltetradecylamine oxide, methylethylhexadecylamine oxide, dimethyl-2-hydroxyoctadecylamine oxide, and coconut fatty alkyl dimethylamine oxide.

Electrolyte Concentration Aids

Inorganic viscosity control agents which can also act like or augment the effect of the surfactant concentration aids, include water-soluble, ionizable salts which can also optionally be incorporated into the compositions of the present invention. Incorporation of these components to the composition must be processed at a very slow rate. Components of this type have now been found less needed in the compositions of the invention, especially where such compositions are in a concentrated form. This has result in a simplification of the process formulation (i.e process time reduction).

A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from 20 to 20,000 parts per million (ppm), preferably from 20 to 11,000 ppm, by weight of the composition. Where the compositions of the invention are in a concentrated form, levels of salts used to control the composition viscosity are reduced by 20% to 50% of such typical levels.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and may improve softness performance. These agents may stabilize the viscosity over a broader range of temperature, especially at low temperatures, compared to the inorganic electrolytes.

Specific examples of alkylene polyammonium salts include 1-lysine monohydrochloride and 1,5-diammonium 2-methyl pentane dihydrochloride.

Another optional ingredient is a liquid carrier. The liquid carrier employed in the instant compositions is preferably at least primarily water due to its low cost relative availability, safety, and environmental compatibility. The level of water in the liquid carrier is preferably at least 50%, most preferably at least 60%, by weight of the carrier. Mixtures of water and low molecular weight, e.g., <200, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Still other optional ingredients are stabilizers, such as well known antioxidants and reductive agents, Soil Release Polymers, emulsifiers, bacteriocides, colorants, perfumes, preservatives, optical brighteners, anti ionisation agents, antifoam agents, enzymes, chelants and builders.

The invention is illustrated in the following non limiting examples, in which all percentages are on a weight: basis unless otherwise stated.

EXAMPLE 1

The following diluted liquid fabric softening compositions A and B were prepared, where Composition A is in accord with the invention and Composition B is a prior art composition:

| | A | B |
|---|---|---|
| DEQA (1) | 2.6 | 2.9 |
| Fatty acid (2) | 0.3 | — |
| Hydrochloride acid | 0.02 | 0.02 |
| Perfume | 1.0 | 1.0 |
| Silicone antifoam | 0.01 | 0.01 |
| Dye | 10 ppm | 10 ppm |
| Water and minors to balance to 100 | | |
| Viscosity (cps)* | 100 | 10 |

(1) Di-(tallowyloxyethyl) dimethyl ammonium chloride
(2) Stearic acid of IV = 0
*as measured with a Brookfield viscosity meter set to a speed of 60 rpm (1 Hertz)

Composition A was seen to have a good phase stability and a stable medium viscosity while Composition B was seen to have perfume phase separation and a water-like viscosity.

EXAMPLE 2

The following concentrated liquid fabric softening compositions C to E were prepared, where Composition C is in accord with the invention and Compositions D and E are prior art compositions:

| | C | D | E |
|---|---|---|---|
| DEQA (1) | 18.0 | 19.0 | 19.0 |
| Fatty acid (2) | 1.0 | — | — |
| Hydrochloride acid | 0.02 | 0.02 | 0.02 |
| Polyethylene Glycol 4000 | 0.6 | 0.6 | 0.6 |
| Perfume | 1.0 | 1.0 | 1.0 |
| Electrolyte (3) | 600 ppm | 600 ppm | 1200 ppm |
| Silicone antifoam | 0.01 | 0.01 | 0.01 |
| Dye | 50 ppm | 50 ppm | 50 ppm |
| | Water and minors to balance to 100 | | |
| Viscosity* (cps) | 40 | >5000 | 40 |

(1) Di-(tallowyloxyethyl) dimethyl ammonium chloride
(2) Tallow fatty acid of IV = 18
(3) Calcium chloride
*as measured with a Brookfield viscosity meter set to a speed of 60 rpm (1 Hertz)

On freshly made products, compositions C was seen to have a good phase stability and a stable medium viscosity as did Composition E which had compensated the absence of fatty acid with an increased level of electrolyte while Composition D was seen to have a gel-like viscosity.

Storage Stability Results

Compositions C and E were then assessed for their storage stability.

Viscosity measures were first made on freshly made product. The products were then put in a room with constant temperature for a specified period of time (See table below).

After said storage period, two viscosity measures were made on the products:

1—when the product is at the specified storage room temperature, and

2—when the product has been left to cool to ambiant temperature (about 22° C.–24° C.) after storage as specified under point 1.

The results are as follows:

| Viscosity stability | C | E |
|---|---|---|
| on freshly made product | 40 cps | 40 cps |
| After one month at 50° C. | 115 cps | 75 cps |
| After cooling from 50 C. to 23 C. | 50 cps | 1400 cps |
| After one month at 35 C. | 35 cps | 53 cps |
| After cooling from 35 C. to 23 C. | 30 cps | 200 cps |

After storage, it can be seen that composition C of the invention has a better storage stability than Composition E.

We claim:

1. A concentrated liquid fabric softening composition comprising a) from 15% to 35% of one or more quaternary biodegradable fabric softening compounds or amine precursors thereof selected from the group consisting of biodegradable quaternary ammonium compounds of the formula:

(I)

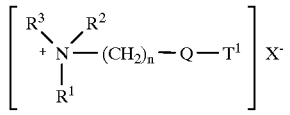

or (II)

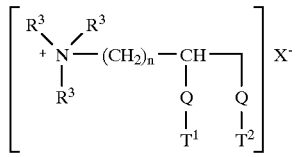

Q is selected from —O—C(O)—, —C(O)—O—, —O—C(O)—O—, —$NR^4$—C(O)—, —C(O)—$NR^4$—;

$R^1$ is $(CH_2)_n$—Q—$T^2$ or $T^3$;

$R^2$ is $(CH_2)_m$—Q—$T^4$ or $T^5$ or $R^3$;

$R^3$ is $C_1$–$C_4$ alkyl or $C_1$–$C_4$ hydroxyalkyl or H;

$R^4$ is H or $C_1$–$C_4$ alkyl or $C_1$–$C_4$ hydroxyalkyl;

$T^1$, $T^2$, $T^3$, $T^4$, $T^5$ are independently $C_{11}$–$C_{22}$ alkyl or alkenyl;

n and m are integers from about 1 to about 4; and $X^-$ is a softener-compatible anion, b) one or more fatty acid compounds, and c) perfume wherein the ratio of said fabric softening compounds to said fatty acid compounds is from about 25:1 to about 6.5:1; and wherein the ratio of said perfume to said total amount of a) and b) is from 1:10 to 1:3.

2. A fabric softening composition according to claim 1, wherein the ratio of said fabric softening compounds to said fatty acid compounds is from 20:1 to 10:1.

3. A fabric softening composition according to claim 1, wherein said fatty acid compounds have a iodine value of 0 to 25.

4. A fabric softening composition according claim 3, wherein said composition further comprises additional fabric softening compounds selected from cationic, nonionic, amphoteric, anionic fabric softening compounds and mixtures thereof.

5. A fabric softening composition according to claim 4, wherein said fabric softening composition has a neat pH at 20° C. in the range of about 2.0 to about 4.5.

6. A method for softening fabrics which comprises contacting, in the rinse cycle of a laundry washing process, fabrics with a fabric softening composition as defined in claim 1.

7. A fabric softening composition according to claim 1, wherein the ratio of said fabric softening compounds to said fatty acid compounds is from about 20:1 to about 10:1.

8. A fabric softening composition according to claim 7, wherein said fatty acid compounds have a iodine value of about 0 to about 25.

9. A fabric softening composition according to claim 8, wherein said composition further comprises additional fabric softening compounds selected from the group consisting of cationic, nonionic, amphoteric, anionic fabric softening compounds and mixtures thereof.

10. A fabric softening composition according to claim 9, wherein said fabric softening compound is N,N-di (tallowoyl-oxy-ethyl)-N,N-dimethyl ammonium chloride.

11. A fabric softening composition according to claim 10, wherein said fabric softening composition has a neat pH at 20° C. in the range of about 2.0 to about 4.5.

12. A method for softening fabrics which comprises contacting, in the rinse cycle of a laundry washing process, fabrics with a fabric softening composition as defined in claim 1.

* * * * *